US006445292B1

(12) United States Patent
Jen et al.

(10) Patent No.: US 6,445,292 B1
(45) Date of Patent: Sep. 3, 2002

(54) PROCESSOR BASED WIRELESS DETECTOR

(75) Inventors: Hsing C. Jen, Barrington; Deborah R. Baricovich, Lisle, both of IL (US)

(73) Assignee: Pittway Corporation, St. Charles, IL (US)

( * ) Notice: Subject to any disclaimer, the term of this patent is extended or adjusted under 35 U.S.C. 154(b) by 0 days.

(21) Appl. No.: 09/829,218

(22) Filed: Apr. 9, 2001

Related U.S. Application Data

(60) Provisional application No. 60/196,685, filed on Apr. 12, 2000.

(51) Int. Cl.[7] ..... G08B 1/08; G08B 23/00

(52) U.S. Cl. ..... 340/539; 340/514; 340/521; 340/588; 340/628; 340/693.3; 340/693.6

(58) Field of Search ..... 340/539, 521, 340/506, 517, 514, 522, 588, 628, 692, 693.3, 693.6

(56) References Cited

U.S. PATENT DOCUMENTS

| | | | | |
|---|---|---|---|---|
| 4,266,220 | A | 5/1981 | Malinowski | 340/630 |
| 4,420,746 | A | 12/1983 | Malinowski | 340/630 |
| 4,737,770 | A | 4/1988 | Brunius et al. | 340/539 |
| 4,951,029 | A | 8/1990 | Severson | 340/539 |
| 5,065,140 | A | 11/1991 | Neuburger | 340/634 |
| 5,283,549 | A | 2/1994 | Mehaffey et al. | 340/521 |
| 5,543,777 | A | 8/1996 | Vane et al. | 340/514 |
| 5,546,074 | A | 8/1996 | Bernal et al. | 340/628 |
| 5,686,885 | A | 11/1997 | Bergman | 340/514 |
| 5,691,704 | A | 11/1997 | Wong | 340/628 |
| 5,708,414 | A | 1/1998 | Peltier et al. | 340/506 |
| 5,726,633 | A | 3/1998 | Wiemeyer | 340/522 |
| 5,736,928 | A | 4/1998 | Tice et al. | 340/511 |
| 5,757,267 | A | 5/1998 | Xydis | 340/539 |
| 5,757,305 | A | 5/1998 | Xydis | 341/173 |
| 5,798,701 | A | 8/1998 | Bernal et al. | 340/628 |
| 5,821,806 | A | 10/1998 | Bernal et al. | 340/630 |
| 5,821,866 | A | 10/1998 | Bernal et al. | 340/630 |
| 5,936,533 | A | 8/1999 | Bernal et al. | 340/630 |
| 6,084,522 | A | 7/2000 | Addy | 340/630 |

OTHER PUBLICATIONS

System Sensor, 2100 ARFT Product Specification, 2100 with Sounder Series, published more than one year before Apr. 9, 2001.

Sentrol, Inc., ESL 429/449 & 428/448 Series Self–Diagnostic Photoelectric Smoke Detectors Installation Instructions; ©1997 Sentrol, Inc.

*Primary Examiner*—Donnie L. Crosland
(74) *Attorney, Agent, or Firm*—Welsh & Katz, Ltd.

(57) ABSTRACT

An energy efficient, easily manufacturable, multi-sensor detector incorporates a smoke sensor and a thermal sensor. A single die programmed processor with integrally formed storage circuits for programs and parameters senses sensor signals, from different types of sensors, during a common activation cycle and processes those signals during the same cycle. The processor can also monitor the condition of an energy supplying battery and provide modulation signals to an audible output device. Other detector functions can be interleaved between output device modulation signals to minimize the cost of the programmed processor and thereby provide the required functionality very cost effectively.

43 Claims, 5 Drawing Sheets

PROCESSOR BASED WIRELESS DETECTOR

This application claims the benefit of the earlier filed Provisional Application Ser. No. 60/196,685, filed Apr. 12, 2000.

FIELD OF THE INVENTION

The invention pertains to wireless detectors usable in alarm systems. More particularly, the invention pertains to such detectors which incorporate single die, multi-function, programmed processors configured for energy efficient battery powered operation.

BACKGROUND OF THE INVENTION

Wireless ambient condition detectors are known. Such detectors, most conveniently, have been battery powered so that they may easily be mounted in a variety of locations without any need for power or communications cables. Known wireless detectors, while effective, have used energy at a rate which did not provide as long a battery life as desirable.

Known detectors have used separate integrated circuits to interface with different types of sensors such as smoke sensors and heat sensors. Signal processing has in turn required other circuits.

One type of circuit which has been used in detectors which incorporate smoke sensors have been application specific integrated circuits (ASIC). ASIC can be very inexpensive and cost effective in high volume, long run products. They are, however, expensive to develop, have long production lead times, and provide little or no flexibility. In addition, conventional ASIC contribute to higher than desirable power requirements.

Known detectors have used a different ASIC for communications and low battery detection. Since the ASIC coupled to the respective smoke sensor and the communications ASIC operate autonomously, they create irregular and unpredictable current draw profiles. In known detectors, this irregular and unpredictable current draw profile impedes accurate battery voltage measurements. As a result of these unpredictable current draws, low battery trouble, voltage thresholds have had to be set higher than desirable. This also contributes to shorter battery life.

Other known prior art detectors use an ASIC to couple electrical energy from the battery to an audible alarm indicating device in the detector. This produces a need for yet another, separate, circuit which must be interconnected with the rest of the circuitry of the detector and which contributes to further current draw.

Additionally, sensitivity compensation, to take into account dust and aging of a sensing chamber, has in some known systems been carried out at a system control panel. Smaller, less expensive control panels may not have the processing capability to implement this function.

One known type of detector based compensation provides a maximum incremental change which can take place in the detector during each compensation cycle. While this process does provide compensation over a period of time, the greater the extent of the required compensation, the longer is the time interval that is required to achieve a desired sensitivity.

Some known detectors which incorporate heat sensors have recognized that heat sensors can be susceptible to nuisance conditions such as electrical noise from static electricity, power surges, radio-frequency interference, as well as thermal noise both from turning the sensor on and off as well as thermal variations from the ambient environment. It has been known to use reference heat sensors to compensate for temperature changes. Such reference heat sensors not only add additional cost to the respective detector but are limited in the thermal noise which can be rejected.

It would be desirable therefore to provide highly energy efficient, multiple sensor detectors which require fewer integrated circuits. Preferably, such detectors could be implemented in a way so as to provide on-going flexibility to designers as product needs evolve, while at the same time extending battery life and providing enhanced rejection of nuisance signals.

SUMMARY OF THE INVENTION

A wireless detector incorporates a single chip, or die, integrated control element. The element includes an integrally formed processor, read-write, reprogrammable read only memory or one time programmable read only memory. Different memory types can be formed on the same die. The same chip can include programmable timers, and I/O ports for both analog and digital inputs or outputs.

In one aspect, the detector includes a photoelectric smoke sensor and at least one heat sensor. Executable instructions implement a common sensing cycle for both types of sensors. Two heat sensors can be incorporated into a disclosed embodiment.

In another aspect, a battery used to power the detector provides an output voltage in a predetermined monitorable range which will support successful operation. A voltage multiplier circuit, coupled to the battery, provides a higher voltage to drive an audible output device in accordance with processor supplied modulation.

In yet another aspect, the detector conserves energy, and extends battery life, by performing sensor sampling and signal processing functions for that sample interval during a single active interval. Then, the circuitry enters a low power, inactive state until the next activate interrupt arrives.

A disclosed embodiment combines different types of sensors, some of which have longer stabilization intervals then others. Different types of sensors can be activated simultaneously. Those with relatively short stabilization intervals can be sampled and the respective signal, or signals, processed, at least in part, during longer stabilization and processing intervals for other types of sensors. This overlap contributes to minimal over-all energy usage during each active interval.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
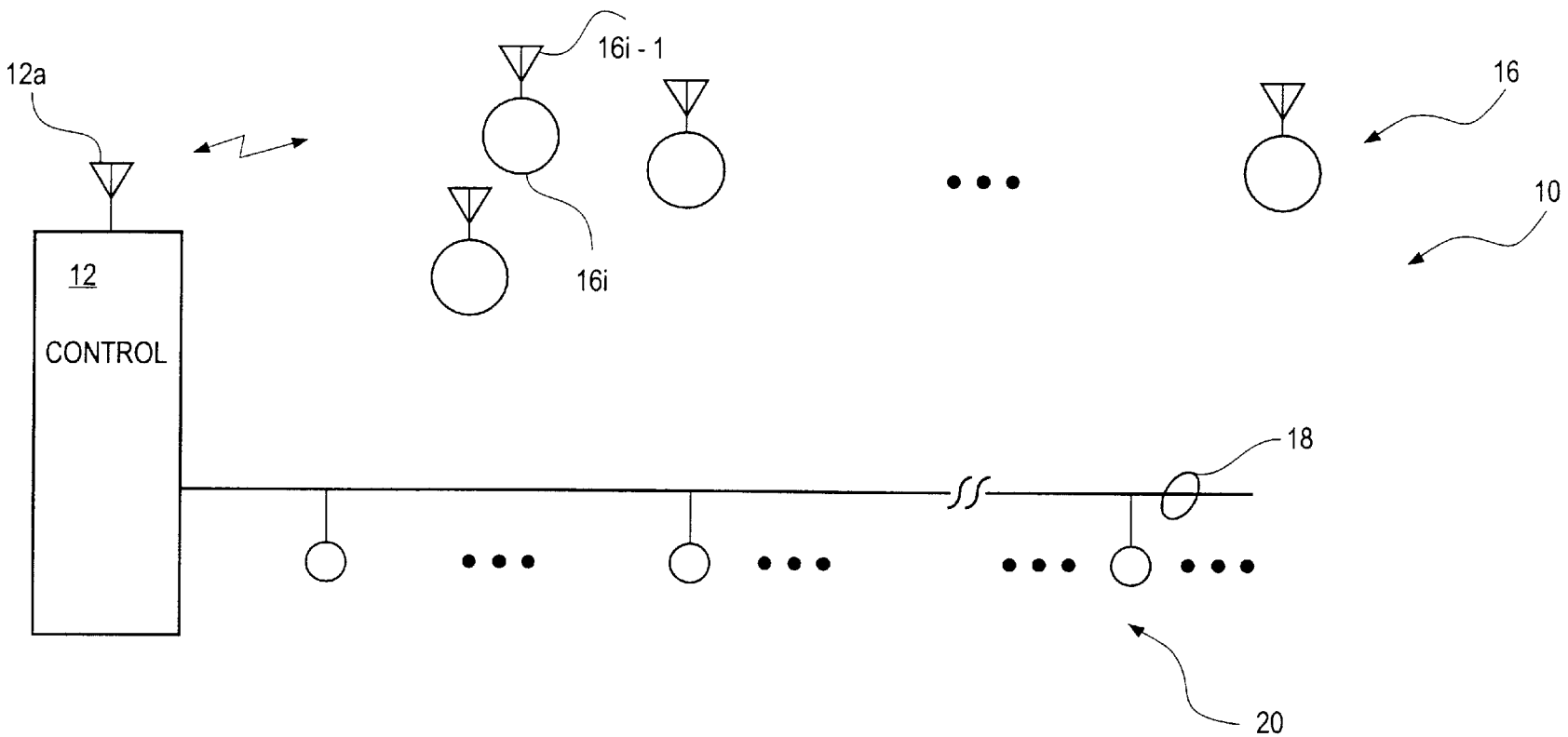
FIG. 1 is a system in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 illustrates a monitoring system 10 in accordance with the present invention. The system 10 incorporates a system control element 12 which could incorporate one or more programmed processors and pre-stored executable instructions. It will be understood that the exact details of the control element 12 are not a limitation of the present invention.

The control element 12 is coupled to a wireless antenna 12*a* wherein the system 10 has been implemented using RF-type wireless transmissions. Other forms of wireless transmission come within the spirit and scope of the present invention.

The members of a plurality of electrical units 16 are wirelessly coupled to control element 12. The members of the plurality 16, for example electrical unit 16*i*, could be implemented as battery powered units having one or more ambient condition sensors for purposes of monitoring a region. The sensors could be responsive to smoke, gas, position, flow, intrusion, movement or the like all without limitation of the present invention. The electrical units 16 via respective antennas, such as antenna 16*i*-1 communicate status information and information pertaining to the condition being monitored to the control element 12. Various levels of processing of the signals from the respective sensor or sensors at the unit 16*i* can be carried out locally and the results thereof transmitted via antennae 16*i*-1 and 12*a* to control element 12.

It will also be understood that system 10 can incorporate one or more wired communication links, representatively illustrated as link 18, coupled to control element 12. Members of a plurality of electrical units 20 can be coupled to link 18 for communication with control element 12. Those of skill in the art will understand that the members of the plurality 20 could incorporate detectors of ambient conditions as well as output or control devices all without limitation of the present invention.

Figure 2:
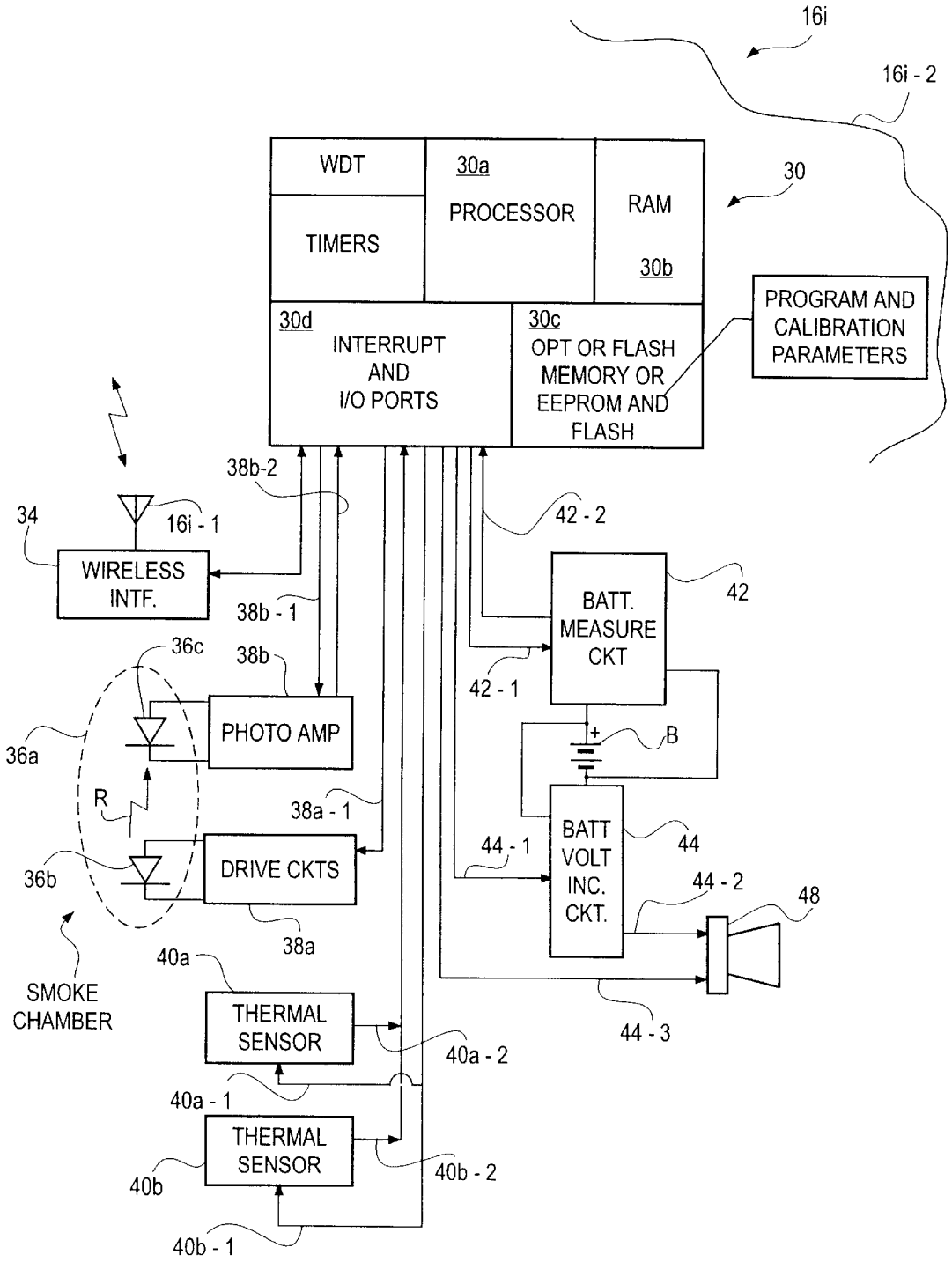
FIG. 2 is a block diagram of an electrical unit usable in the system of FIG. 1.

FIG. 2 illustrates more details of a representative member 16*i* of the plurality 16. The electrical unit 16*i* is carried in a housing 16*i*-2. The housing 16*i*-2 can be mounted to a selected surface.

The unit 16*i* includes a single die, programmed, control element 30. The element 30 includes a processor 30*a*, read/write memory 30*b*, and non-volatile memory 30*c*. The read/write memory 30*b* can be implemented using a variety of random access or quasi random access technologies as would be understood by those of skill in the art within the spirit and scope of the present invention.

The non-volatile memory 30*c* can be implemented with a variety of non-volatile technologies including OPT, flash memory, EEPROM or PROM storage circuitry or combinations thereof. It will be understood that executable instructions and calibration parameters can be stored in one or more types of non-volatile memory all on the same die. By use of EEPROM or other types of reprogrammable storage, parameters and/or executable instructions can be up-dated wirelessly from time to time as a result of commands and files received from the control element 12. In addition, when the unit 16*i* is being manufactured, executable instructions can be written therein, executed and/or modified without having to be delayed by expensive revisions to mask sets.

The control element 30 includes, integrated on the same die, interrupt and I/O ports 30*d*. Circuitry 30*a*, 30*b*, 30*c* and 30*d* are all interconnected on the single die resulting in a single chip element which also promotes manufacturability.

Storing the executable instructions and calibration parameters in the same type of non-volatile memory, or in different types of non-volatile memory, but all on the same die, eliminates any need for separate integrated circuitry and associated interfaces, interconnections and the like. As will be understood by those of skill in the art, and discussed in more detail subsequently, sensor control and processing as well as other local functions and communications with control element 12 are implemented, in part, via the executable constructions in the non-volatile memory 30*c* in combination with local hardware.

The unit 16*i* also includes a wireless interface 34 coupled to the I/O ports 30*d* and antenna 16*i*-1. As those of skill in the art will understand, a variety of wireless interfaces can be used in the unit 16*i* without departing from the spirit and scope of the present invention so long as the interfaces enable the respective units, such as the unit 16*i* to communicate with the control element 12 wirelessly. Preferably, communication will be bidirectional although unidirectional communication from the respective electrical units 16 comes within the spirit and scope of the present invention.

The illustrated electrical unit 16*i* also includes a smoke chamber 36*a*. Chamber 36*a* is configured to permit an inflow and outflow of smoke carrying ambient atmosphere in the vicinity of the unit 16*i*. Mounted within or adjacent to the chamber 36*a* are a radiant energy source 36*b*, and, a radiant energy receiver 36*c*. The radiator 36*b*, which could be a laser diode or a light emitting diode, and the receiver 36*c* which could be a photo diode or a photo transistor. They are configured, in chamber 36*a*, to provide a smoke sensing function, commonly referred to as a photo electric smoke sensor, as would be understood by those of skill in the art.

Drive circuits 38*a* coupled to I/O port 30*d* and emitter 36*b* provide electrical energy to emitter 36*b* under control of instructions being executed by processor 38. Similarly, photo amp 38*b* coupled between I/O ports 30*d* and sensor 36*c* via an activate line 38*b*-1 and an amplified sensor output line 38*b*-2 make it possible to drive emitter 36*b* via instructions being executed in processor 30*a*, activate sensing amplifier 38*b* and receive an analog signal therefrom via line 38*b*-2. The analog signal on line 38*b*-2 can be converted in an analog-to- digital converter integral to I/O ports 30*d*. The resulting digitized value can be processed via instructions executed by processor 30*a*. It will be understood that the photo-amp 38*b* can be eliminated where the analog-to-digital converter has sufficient resolution.

Representative first and second thermal or heat sensors 40*a* and 40*b* are coupled via one or more sensor activate lines 40*a*-1 and 40*b*-1 to I/O ports 30*d*. It will be understood that one or more than two thermal sensors could be used without departing from the spirit and scope of the present invention. Analog output signals from sensors 40*a*, 40*b* can be coupled via one or more output lines 40*a*-2 and 40*b*-2 to I/O ports 30*d*. It will be understood that either a common activate line or a common feedback line or multiple activate or multiple feedback lines can be used to control or receive signals from the thermal sensors 40*a,* 40*b* without departing from the spirit and scope of the present invention.

The processor 30*a* can periodically and autonomously activate sensors 40*a,* 40*b* via respective lines 40*a*-1, 40*b*-1. This in turn provides analog signals, indicative of ambient adjacent thermal conditions on output lines 40*a*-2, 40*b*-2. These signals can then be digitized and processed by processor 30*a*.

As described in more detail subsequently, with respect to FIG. 3, the processor 30*a,* to minimize average energy requirements, can be activated only during intermittent spaced apart time intervals. Both smoke sensing and thermal sensing takes place during a common activation interval. Processing of the received signals from the respective sensors also takes place during the same activation interval.

The unit 16*i* is preferably energized by a replaceable battery B. A battery condition measuring circuit 42 is coupled to I/O ports 30*d* via an activation line 42-1 and a battery parameter feedback line, indicative of battery voltage, 42-2. The condition of the battery B can be periodically evaluated by processor 30*a* by activating measurement circuitry 42. The condition of the battery B can then be monitored in real-time by processor 30*a* with a known current profile. For monitoring purposes, the value received from measuring circuit 42, on line 42-2 can be compared to a factory programmed threshold value. If the sensed voltage of the battery B is below the preset threshold, the processor 30*a* can carry out a prestored low battery voltage routine.

Voltage incrementing circuit 44 is coupled to battery B and enabling line 44-1, for example a voltage multiplying circuit, can be used to generate an audible device output driving voltage on line 44-2. This driving voltage substantially exceeds the value of the voltage of the battery B. The applied high voltage on the line 44-2 can be modulated via processor 30*a* and output line 44-3 to drive audible output device 48. This device could be implemented as an audible sounder or piezo-electric device without limitation.

As discussed in more detail subsequently with respect to FIG. 4, processor 30*a* directly drives battery voltage incrementing circuit 44 to produce an output voltage on line 44-2 sufficiently high to operate the sounder. The sounder via line 44-3 can be modulated in accordance with one or more pre-stored output patterns. For example, an ANSI S 3.41 output pattern can be stored and audibly output via device 48 where the units 16 are marketed in the United States. Alternately, a Canadian Standards Association, CSA, output pattern can be stored and output for electrical units installed in Canadian markets.

When processor 30*a* is generating an audible output pattern, use is made of the silent intervals between tone bursts to carry on a non-tonal processing such as reading sensor values, processing sensor values, reading battery values processing battery output values and executing communication sequences. By multiplexing these operations, only the single processor 30*a* need be used. Using this same multiplexing approach, a low battery audible indicator can also be produced as appropriate.

Figure 3:
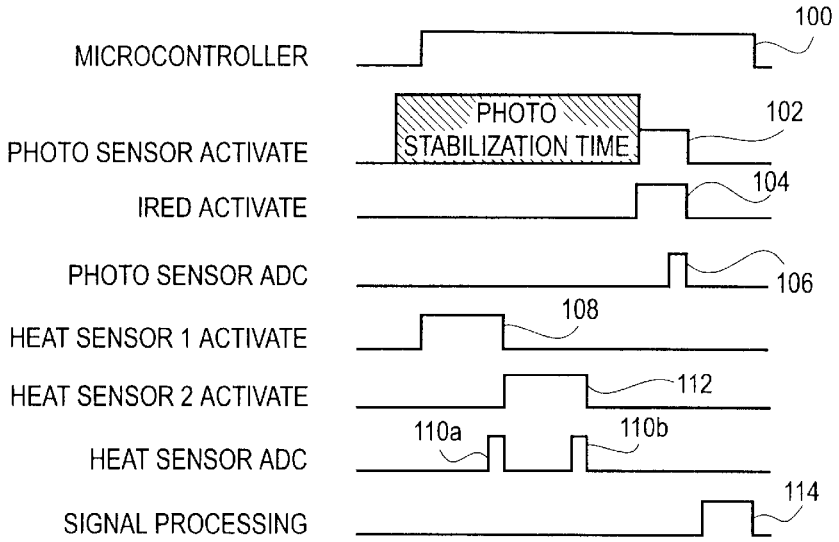
FIG. 3 is a timing diagram illustrating various aspects of the operation of the unit of FIG. 2.

The timing diagrams of FIG. 3 illustrate the energy efficient operation of the electrical unit 16*i*. Graph 100 illustrates one of a plurality of spaced apart active intervals for the control circuits 30. During this interval, the resources of the processor 30*a* can be devoted to sensor sampling and signal processing. For example and without limitation, graph 102 illustrates a stabilization and sensing interval of photo amplifier 38*b,* activated via line 38*b*-1. As illustrated in graph 104, the emitter 36*b* is activated via drive circuits 38*a,* line 38*a*-1 near the end of the stabilization interval. This in turn produces radiant energy R in sample chamber 36*a,* a portion of which, indicative of smoke, is converted to an electrical signal output via photo amp 38*b*. This signal is sampled, graph 106, and converted to a digital value at the end of the emitter activate interval.

During the photo amplifier stabilization interval, graph 102, one of the thermal sensors such as 40*a,* can be activated for a predetermined period of time, graph 108. An analog output therefrom, line 40*a*-2 can be sampled and digitized at the I/O port 30*d,* signal 110*a*.

A second heat or thermal sensor, such as sensor 40*b* can be subsequently activated, graph 112. An analog output therefrom, line 40*b*-2, can be sampled and digitized at the end of the activation interval 112, waveform 110*b*. Subsequently, graph 114, the acquired values from the smoke sensor and the thermal sensors can be processed.

Figure 4:
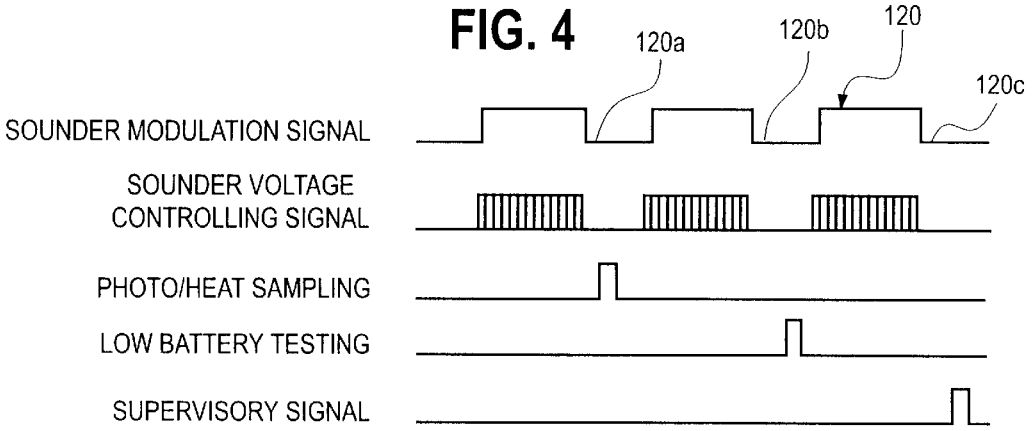
FIG. 4 is a timing diagram illustrating other aspects of the operation of the unit of FIG. 2.

FIG. 4 illustrates a set of timing diagrams wherein a modulation signal, graph 120, is presented via line 44-3 to an audible output device or sounder. During the time interval wherein the sounder ON signal is being provided, graph 120, processor 30*a* via line 44-1 and voltage increasing circuit for example voltage multiplier circuit 44 can be driven thereby producing on the output line 44-2 a high enough output voltage to properly drive the sounder 48. During sounder OFF intervals, for example between internal tonal groups, such as 120*a,* 120*b* and 120*c,* sensor activation and signal processing, as illustrated in FIG. 3 can be carried out. Additionally, low battery testing, discussed above as well as any supervisory signal generation can be carried out and implemented in any of intervals 120*a,* 120*b* or 120*c*.

Figure 5:
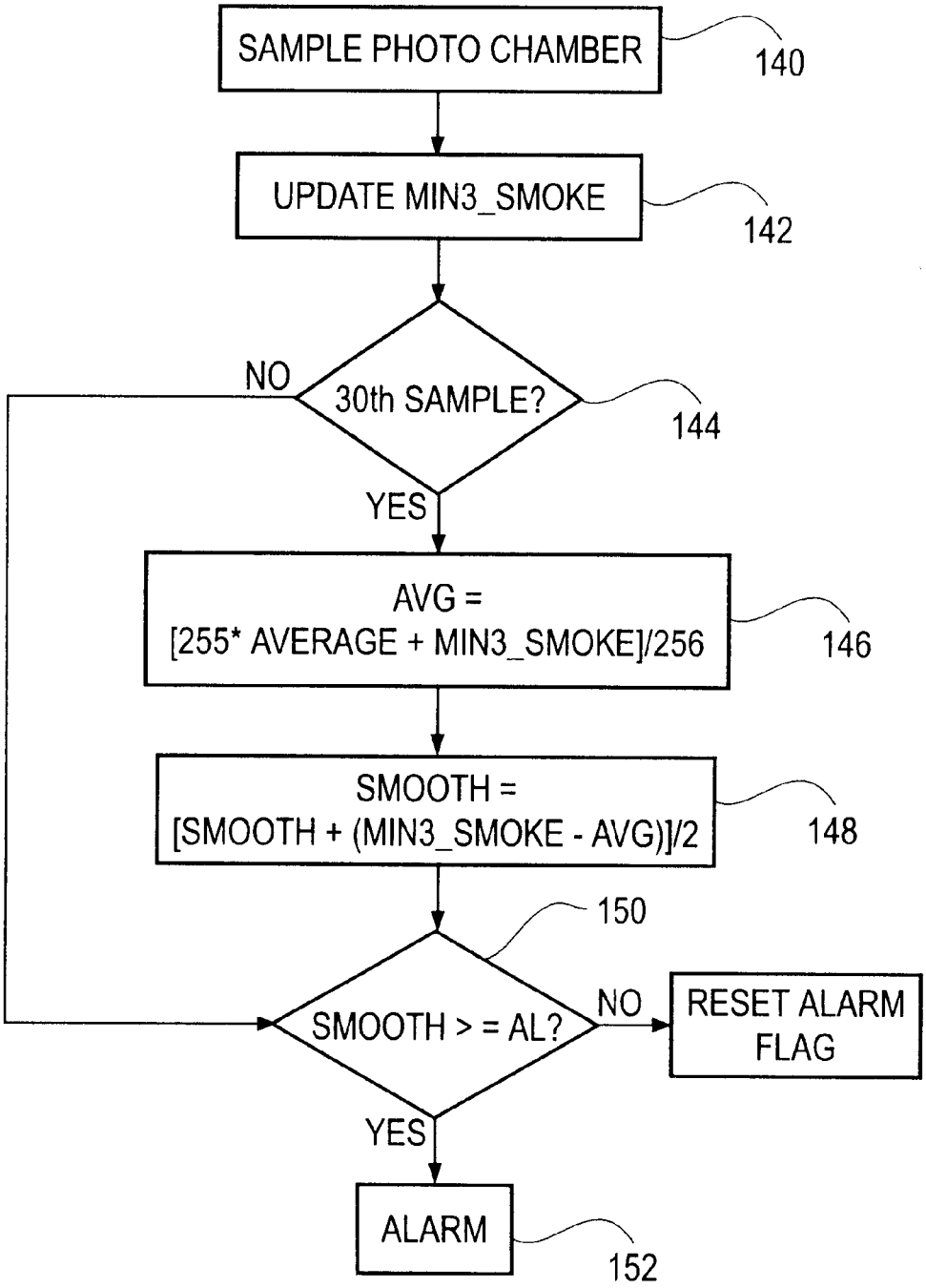
FIG. 5 is a block diagram illustrating a method of processing signals from a smoke sensor carried by the unit of FIG. 2.

As noted above, sensor signal processing can be carried out in the same activate cycle as the signal has been acquired, graph 114, FIG. 3. FIG. 5 is a flow diagram of processing in accordance herewith.

With respect to FIG. 5, on a periodic basis and autonomously, the processor 30*a* samples the photo sensor 36*c,* step 140. This sensor output is processed and filtered to produce an adjusted value, for example Min3 processing as described in Tice U.S. Pat. No. 5,736,928, step 142. The value of Min3_smoke is updated with every photo sample.

On every thirtieth photo sample, step 144, the updated Min3_smoke value is used to calculate a running average, Avg step 146. The running average is calculated using, for example, a sample size of 256. It will be understood that other numbers of samples could be used without departing from the spirit and scope of the present invention.

Another value, Smooth, which represents the short-term increase in Min3_smoke, is computed, step 148, by averaging the last two differences between Min3_smoke and corresponding Avg. Smooth is greater than zero when Min3_smoke is increasing. Smooth declines to zero when Min3_smoke remains constant or decreases.

The most recent value of Smooth is compared with a predetermined value, step 150. When exceeded, an alarm signal is transmitted and an indication is given at the detector step 152. The above described steps not only filter out sensor noise, minimizing false alarms, they also carry out sensitivity compensation.

Figure 6:
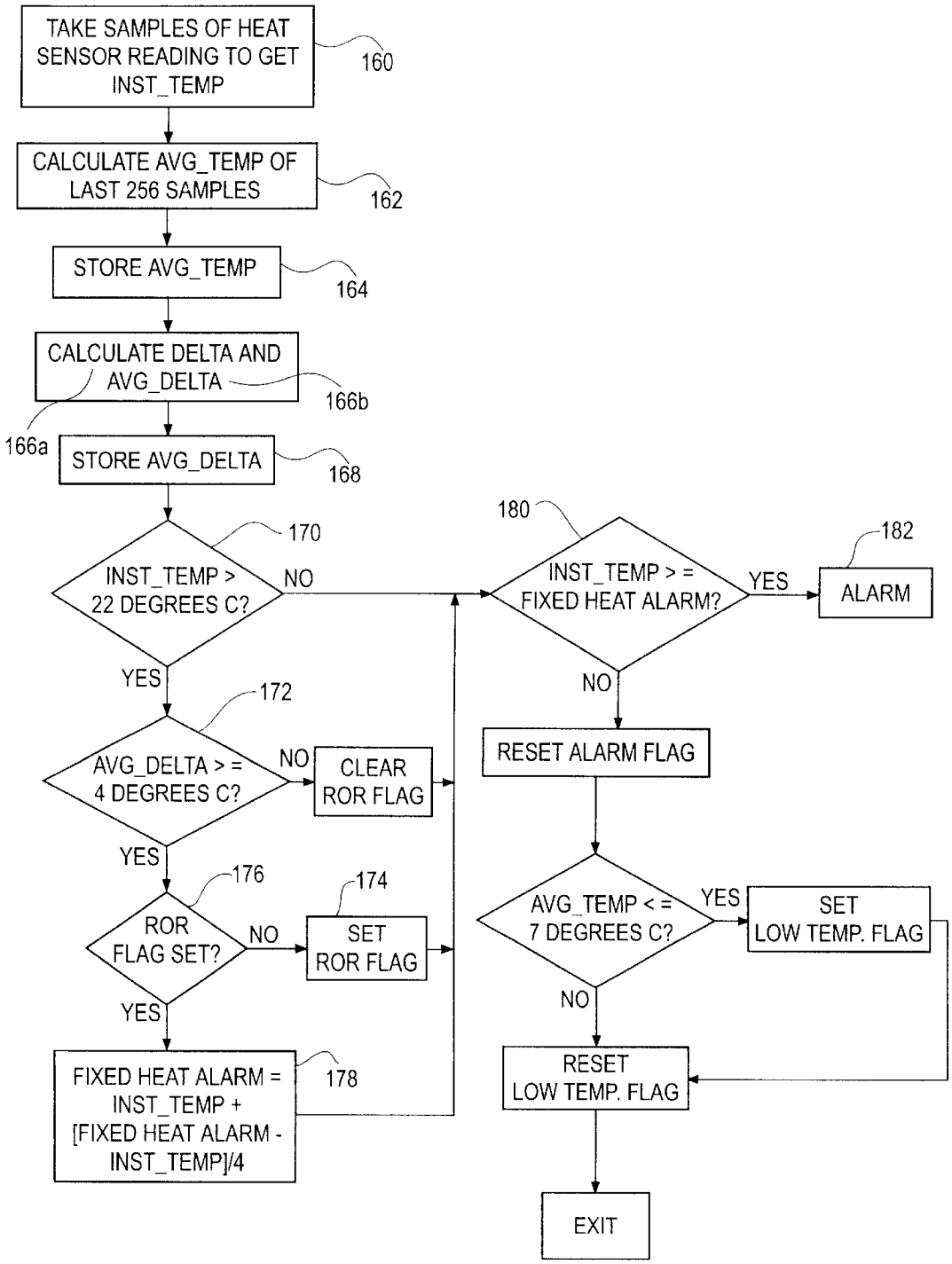
FIG. 6 is a flow diagram illustrating processing of signals associated with one or more heat sensors carried by the electrical unit of FIG. 2.

With respect to FIG. 6, on a periodic basis and autonomously, the processor 30*a* samples the reading of a heat sensor, such as sensor 40*a,* graph 108, step 160. A value, Avg_temp, representing the running average of the last 256 consecutive Inst_temp. including the most recent sample, is calculated, step 162, and stored in memory, step 164. Another value, Delta, representing the difference between the most recent Inst_temp and the most recent Avg_temp is calculated step 166*a*. A third value, Avg_delta is calculated step 166*b* by taking the running average of the last 12 consecutive Deltas and then stored, step 168.

The current reading is compared to 22 degrees C., step 170. If above 22 degrees C. and if Avg_delta is greater than or equal to 4, step 172, then the flag ROR is set step 174.

If ROR is set, step 176*i* the fixed heat alarm threshold is set to a value that is higher than the most recent Inst_temp by an amount equal to 25% of the difference between the most recent Inst_temp and the predetermined fixed heat alarm threshold step 178. This makes the detector more sensitive by allowing the detector to alarm at a temperature lower than the predetermined fixed heat alarm threshold.

If Avg_delta is less than 4, then the fixed heat alarm threshold will not be reduced. The detector in this case will respond at the predetermined fixed heat alarm threshold step 180. This process is repeated for the second heat sensor 40*b*.

By setting the heat alarm threshold above the current Inst_temp by a percentage of the difference between the current Inst_temp and the predetermined fix heat alarm threshold, a single adjustment would not be able to cause a valid alarm condition to occur. This reduces the chance of false alarms.

Where more than one heat sensor is employed, when Avg_delta becomes greater or equal to 4 for one heat sensor, the fixed heat alarm thresholds for all heat sensors are adjusted. The adjustment to heat alarm threshold is only made if the temperature is above 22° C., i.e. room temperature, step 170. The Avg_temp, and Avg_delta values for each heat sensor are stored individually. Inst_temp is also compared to the predetermined heat alarm threshold step 180. When exceeded, an alarm signal is transmitted and an indication is given at the detector, step 182. Inst_temp is also compared to a second heat threshold. When exceeded, a trouble signal, different from an alarm signal, is transmitted and an indication is given at the detector.

It will be understood that smoke sensor output signals and thermal sensor output signals can be processed using a variety of methods without departing from the spirit and scope of the present invention. Similarly, other types of sensors can be incorporated into unit 16*i* without departing from the spirit and scope of the present invention.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A detector comprising:

at least one ambient condition sensor;

an audible output device for producing an interrupted audio tonal pattern having predetermined on and off intervals; and a control circuit coupled to the sensor and to the device wherein in response to the presence of a selected, sensed ambient condition the control circuit drives the output device in accordance with the predetermined on and off intervals and wherein during the on intervals the control circuit is substantially completely dedicated to providing electrical energy for driving the output device and wherein during off intervals the control circuit carries out different, non-driving functions.

2. A detector as in claim 1 which includes a wireless output circuit, coupled to the control circuit.

3. A detector as in claim 2 which includes a replaceable power source coupled to a voltage increasing circuit.

4. A detector as in claim 3 wherein the power source comprises a battery.

5. A detector as in claim 4 which includes a voltage multiplier circuit coupled between the battery and the output device.

6. A detector as in claim 1 which incorporates a second, different, sensor wherein the control circuit comprises executable instructions for establishing a sampling cycle and for sampling both sensors during the sampling cycle.

7. A detector as in claim 6 wherein the executable instructions implement at least one stabilization interval prior to sampling the sensors.

8. A detector as in claim 7 which includes a third sensor, substantially identical to the second sensor and comprising executable instructions for sampling the third sensor during the sampling cycle.

9. A detector as in claim 8 wherein one sensor comprises a smoke sensor and another comprises a heat sensor.

10. A detector as in claim 6 wherein the control circuit comprises a programmed processor configured with an intermittent active cycle which includes the sampling cycle and wherein the control circuit requires a first power level during each active cycle and a substantially reduced power level between active cycles thereby reducing average required power.

11. A detector as in claim 10 which includes executable sensitivity compensation instructions wherein different degrees of compensation are achieved in a substantially common time interval.

12. A detector as in claim 10 which includes executable sensor signal processing instructions which respond to a non-alarm indicating ambient condition from one of the sensors to adjust an alarm indicating threshold for that sensor.

13. A detector as in claim 12 wherein the one sensor is a thermal sensor and the other is a smoke sensor.

14. A detector as in claim 13 which incorporates a second thermal sensor.

15. A system comprising:

a common control panel;

a plurality of wireless ambient condition detectors in wireless communication with the panel wherein the detectors each include:

a control circuit;

a wireless interface coupled to the control circuit;

at least one ambient condition sensor coupled to the control circuit;

an alarm indicating tonal output device, coupled to the control circuit wherein the output device is intermittently drivable during selected spaced apart intervals; and a multiplier circuit coupled to the control circuit and to the output device, wherein the control circuit drives the multiplier circuit during the spaced apart intervals, substantially to the exclusion of carrying out different control functions, and, wherein the control circuit carries out the different control functions between the spaced apart intervals.

16. A system as in claim 15 wherein the detectors each include a replaceable energy source with an output port which is coupled to the multiplier circuit.

17. A system as in claim 15 wherein some detectors include a common die for at least a processor and non-volatile storage of executable instructions and parameter values.

18. A system as in claim 17 wherein the storage comprises at least one of flash memory, PROM and EEPROM on the common die.

19. A system as in claim 15 wherein the control circuit comprises executable instructions for, in part, carrying out as one different control function, processing signals received from the sensor.

20. A system as in claim 19 wherein the instructions establish at least one sample interval having a predetermined period.

21. A detector comprising:

a control circuit;

a wireless interface coupled to the control circuit;

at least one ambient condition sensor coupled to the control circuit;

an alarm indicating tonal output device, coupled to the control circuit wherein the output device is intermittently drivable during selected spaced apart intervals; and a multiplier circuit coupled to the control circuit and to the output device, wherein the control circuit drives the multiplier circuit during the spaced apart intervals, substantially to the exclusion of carrying out different control functions, and, wherein the control circuit carries out the different control functions between the spaced apart intervals.

22. A detector as in claim 21 which includes a replaceable energy source with an output port which is coupled to the multiplier circuit.

23. A detector as in claim 21 which includes a single die for at least a processor and non-volatile storage of executable instructions and parameter values.

24. A detector as in claim 23 wherein the storage comprises at least one of flash memory, PROM and EEPROM on the die.

25. A detector as in claim 21 wherein the control circuit comprises executable instructions for, in part, carrying out as one different control function, processing signals received from the sensor.

26. A detector as in claim 23 wherein the processor exhibits an active interval having a predetermined period and wherein executable instructions carry out sensor sampling and signal processing during the interval.

27. A detector as in claim 26 wherein executable instructions carry out a fixed time interval compensation process irrespective of degree of compensation.

28. An apparatus comprising:

a semiconductor die;

a programmable processor formed on the die;

first and second different types of storage formed on the die and coupled to the processor wherein instructions, executable by the processor, are stored in some of the storage locations and parameter values are stored in other locations;

a digital input/output port formed on the die and coupled to the processor; and at least one ambient condition sensor coupled to the processor.

29. An apparatus as in claim 28 wherein some of the executable instructions comprise modulation instructions for audible output device drive signals.

30. An apparatus as in claim 29 wherein other instructions process output signals from first and second different ambient condition sensors.

31. An apparatus as in claim 28 wherein some of the instructions comprise wireless communication instructions.

32. An apparatus as in claim 28 wherein some of the instructions comprise analog-to-digital conversion instructions.

33. An apparatus as in claim 30 wherein other instructions implement a battery test function during time intervals not associated with ambient condition sensing.

34. An apparatus as in claim 30 which includes first and second different ambient condition sensors, each of which is coupled to an input port.

35. An apparatus as in claim 34 wherein the sensors output analog signals and the input port comprises an analog-to-digital converter.

36. An apparatus as in claim 34 which includes executable instructions for activating both sensors at substantially the same time.

37. An apparatus as in claim 36 wherein the processor is only activated to execute instructions during predetermined intervals and wherein sensor output signals are acquired and processed during the same interval during which the sensors are activated.

38. An apparatus as in claim 37 which includes instructions for carrying out a sensor compensation process.

39. An apparatus as in claim 38 wherein differing degrees of compensation are implemented during substantially the same elapsed time.

40. An energy efficient, wireless ambient condition detector comprising:

first and second different types of fire sensors;

programmed control circuitry for energizing both types of sensors, in part simultaneously, during a plurality of spaced apart, active, time intervals of the control circuitry wherein the circuitry includes executable instructions for compensating one of the sensors, over a range, during a substantially constant temporal interval wherein the circuitry repetitively enters energy saving inactive intervals which bound the members of the plurality;

a wireless interface for communication of status information to a displaced alarm system control panel; and battery monitoring circuitry, coupled between a battery and the control circuitry wherein the control circuitry executes instructions for evaluating the energy remaining in the battery.

41. A detector as in claim 40 wherein one sensor is a smoke sensor and another is a thermal sensor wherein the executable instructions energize the smoke sensor for a longer, overlapping interval than the thermal sensor is energized.

42. A detector as in claim 41 which includes an audible output device and an interface coupled between the output device and the control circuitry wherein executable instructions drive the interface and the sounder during a plurality of spaced apart active intervals, temporally displaced from active intervals wherein the sensors are energized.

43. A detector as in claim 42 wherein the interface includes a voltage multiplier circuit.

* * * * *